US007331841B2

(12) United States Patent
Okamoto et al.

(10) Patent No.: US 7,331,841 B2
(45) Date of Patent: Feb. 19, 2008

(54) TRANSFORMABLE TOY

(75) Inventors: Koji Okamoto, Kanagawa (JP); Ryosuke Toriyama, Kanagawa (JP); Shinya Saito, Kyoto (JP); Shinichi Hanamoto, Tokyo (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 207 days.

(21) Appl. No.: 10/557,507

(22) PCT Filed: May 18, 2004

(86) PCT No.: PCT/JP2004/006652

§ 371 (c)(1),
(2), (4) Date: Jan. 17, 2006

(87) PCT Pub. No.: WO2004/101096

PCT Pub. Date: Nov. 25, 2004

(65) Prior Publication Data

US 2006/0258260 A1 Nov. 16, 2006

(30) Foreign Application Priority Data

May 19, 2003 (JP) ..... 2003-141207

(51) Int. Cl.
*A63H 3/46* (2006.01)
*A63H 33/00* (2006.01)

(52) U.S. Cl. ..... 446/376; 446/487

(58) Field of Classification Search ..... 446/97, 446/99, 100, 101, 321, 320, 376, 377, 383, 446/487

See application file for complete search history.

(56) References Cited

U.S. PATENT DOCUMENTS 2,623,329 A * 12/1952 Di Leva ..... 446/320
4,411,097 A * 10/1983 Murakami ..... 446/376
4,516,948 A * 5/1985 Obara ..... 446/95

(Continued)

FOREIGN PATENT DOCUMENTS

GB 2153242 A * 8/1985

(Continued)

*Primary Examiner*—Eugene Kim
*Assistant Examiner*—Alyssa M Hylinski
(74) *Attorney, Agent, or Firm*—Rankin, Hill, Porter & Clark LLP

(57) ABSTRACT

The present invention provides a transformable toy of which a figure is transformed between a doll robot toy and a four-legged walking robot toy with rear-leg sections thereof of a more natural shape. One of a pair of leg sections 11 of the doll robot toy 1 is provided with a knee-position connecting mechanism 114 for connecting a thigh section 111 and a shin section 112 and an ankle-position connecting mechanism 115 for connecting the shin section 112 and a foot section 113. The knee-position connecting mechanism 114 includes a connecting link 118 connected to both of the thigh section 111 and the shin section 112 respectively with turning pairs 116 and 117. The ankle-position connecting mechanism 115 is so constructed as to connect the shin section 112 and the foot section 113 with a turning pair 119. Then, the shin section 112 is length-adjustably constructed so that it can become long in a figure of the doll robot toy and become short in a figure of the four-legged walking robot toy.

7 Claims, 6 Drawing Sheets

U.S. PATENT DOCUMENTS

| | | | | |
|---|---|---|---|---|
| 4,571,203 | A * | 2/1986 | Murakami | 446/95 |
| 4,594,071 | A * | 6/1986 | Zaruba et al. | 446/99 |
| 4,614,504 | A * | 9/1986 | Yamasaki | 446/356 |
| 6,568,984 | B1 * | 5/2003 | Applewhite | 446/176 |

FOREIGN PATENT DOCUMENTS

| | | | |
|---|---|---|---|
| GB | 2155346 | A * | 9/1985 |
| JP | 61-199877 | | 9/1986 |
| JP | 62-122694 | | 8/1987 |
| JP | 63-22982 | | 2/1988 |
| JP | 63-22987 | | 2/1988 |
| JP | 9-10442 | | 1/1997 |
| JP | 9-28933 | | 2/1997 |

* cited by examiner

TRANSFORMABLE TOY

TECHNICAL FIELD

The present invention relates to a transformable toy, a figure of which is transformed from a certain toy robot into another toy robot.

BACKGROUND ART

The conventional arrangements of transformable toys, of which figures are transformed from a vehicle or an animal into a doll robot, are disclosed in the Japanese Laid-Open Patent Publication (Kokai) No. 10442/1997 or the Japanese Laid-Open Patent Publication (Kokai) No. 28933/1997. Various kinds of transformable toys are commercially available on the market. In the conventional transformable toys, various kinds of joint structures are used to change the figures thereof.

DISCLOSURE OF THE INVENTION

Problems to be Solved by the Invention

In the conventional transformable toys, however, when a doll robot toy having leg sections is transformed into a four-legged walking robot toy such as a lion or a dog, there has been a problem that the shapes of rear-leg sections of the four-legged walking robot toy look unnatural. This is because the leg sections of the doll robot toy are too long for the rear-legs of the four-legged walking robot toy.

Accordingly, it is an object of the present invention to provide a transformable toy of which a figure is transformed between a doll robot and a four-legged walking robot, in which the rear-leg sections of the four-legged walking robot toy are turned into a more natural shape.

It is another object of the present invention to provide a transformable toy, in which the above-described object can be achieved with a simple arrangement.

It is still another object of the present invention to provide a transformable toy, in which a shape of the leg sections of the doll robot toy does not look unnatural even when the four-legged walking robot toy is equipped with foot-claw sections in the rear-leg sections thereof.

It is a further object of the present invention to provide a transformable toy, in which the four-legged walking robot toy can be constructed without thoroughly hiding a head section of the doll robot toy.

It is a still further object of the present invention to provide a transformable toy, in which arm sections of the doll robot toy can be turned into a more natural shape even when the four-legged walking robot toy is equipped with claw member sections in foreleg sections thereof.

[Patent document 1] Japanese Laid-Open Patent Publication (Kokai) No. 10442/1997

[Patent document 2] Japanese Laid-Open Patent Publication (Kokai) No. 28933/1997

Means of Solving the Problems

The present invention aims at improvements of a transformable toy of which a figure is transformed between the doll robot and the four-legged walking robot. In the transformable toy of the present invention, a pair of arm sections of the doll robot toy are turned into a pair of foreleg sections of the four-legged walking robot toy, and a pair of leg sections of the doll robot toy are turned into a pair of rear-leg sections of the four-legged walking robot toy. Each of the pair of leg sections of the doll robot toy comprises a knee-position connecting mechanism for connecting a thigh section and a shin section, and an ankle-position connecting mechanism for connecting between the shin section and a foot section. The knee-position connecting mechanism includes a connecting link that is connected to the thigh section and the shin section with turning pairs respectively so that the link may rotate about rotating-shafts. The ankle-position connecting mechanism is so constructed as to connect the shin section and the foot section with a turning pair. A length of the shin section can be adjusted, or he shin section is length-adjustably constructed. Such a construction allows the doll robot toy to secure a necessary/sufficient length for the leg sections thereof. It also allows the four-legged walking robot toy to have the rear-leg sections of a more natural shape by shortening the shin sections thereof and appropriately rotating the connecting links connected to the thigh sections and the shin sections with turning pairs respectively.

The adjustment of the length of the shin sections can be accomplished with an easy construction, for example, by making the shin section comprise a first section connected to the connecting link, a second section connected to the foot section, and a slidably connecting mechanism for slidably connecting the first section and the second section so that the first and second sections may slide close to and apart from each other. Since the slidably connecting mechanism can adjust the length of the shin sections with an easy operation of firmly holding either of the first section or the second section while moving the other, transforming operation becomes very easy.

The foot section may comprise a foot-claw section, a foot base section, and a movably connecting mechanism which movably connects the foot-claw section and the foot base section so that the foot-claw section may move with respect to the foot base section. As the movably connecting mechanism, for example, a pivot or hinge mechanism can be used, arranged between the foot-claw section and the foot base section so that the foot-claw section can be located on the edge or instep of the foot base section. When the foot section is too thick, it will become difficult to locate the foot-claw section on the instep of the foot base section. Therefore in this case, the movably connecting mechanism includes a connecting link that is connected to the foot-claw section and the this manner, the foot-claw section can be located entirely on the instep of the foot base section by appropriately setting up the length of the connecting link. As a result, the length of the foot section will never become unnaturally long.

A head base section of the four-legged walking robot toy is connected to a body section of the doll robot toy via a pivotally connecting mechanism so that the head base section of the four-legged walking robot toy can move between a front position and an upper position of the body section of the doll robot toy. A head section of the doll robot toy is so constructed as to be received in the head base section of the four-legged walking robot toy so that the head section of the doll robot toy can constitute a part of the head base section of the four-legged walking robot toy when the head base section of the four-legged walking robot toy is placed in the upper position. In this manner, it is not necessary to hide the doll robot toy thoroughly when the figure changes into the four-legged walking robot toy from the doll robot toy. As a result, mounting or receiving structure for the head of the doll robot toy becomes simple.

The head section of the doll robot toy is provided with a pair of projections protruding upward. The head section of the doll robot toy is rotatably connected to the body section so that the head section of the doll robot toy can be rotated at least backward. In the figure of the four-legged walking robot toy, the head section of the doll robot toy rotates backward so that the pair of projections may constitute ear sections or horn sections of the four-legged walking robot toy. In this manner, even when the head base section of the four-legged walking robot toy is located in the front side of the doll robot toy, the figure of the doll robot toy will not become too much complicated because there are no ears or horns.

When each of the arm sections of the doll robot toy comprises an upper arm section, a lower arm section, and a hand section, a connecting section for connecting the lower arm section to the hand section has a rotatable joint structure provided with a rotating member that rotates, with respect to the lower arm section and the hand section, about the centerline extending in a direction from the lower arm section to the hand section. A claw member provided at the foreleg section of the four-legged walking robot toy is attached to the rotating member. In this way, it is possible to arrange the claw member to the side of the hand section to serve as a weapon when the transformable toy is in a figure of the doll robot toy, and to arrange the claw member ahead of the hand section in a figure of the four-legged walking robot toy. As a result, the claw member can be arranged in a location suitable for each of the toy robot figures.

BEST MODE FOR CARRYING OUT THE INVENTION

Figure 1:
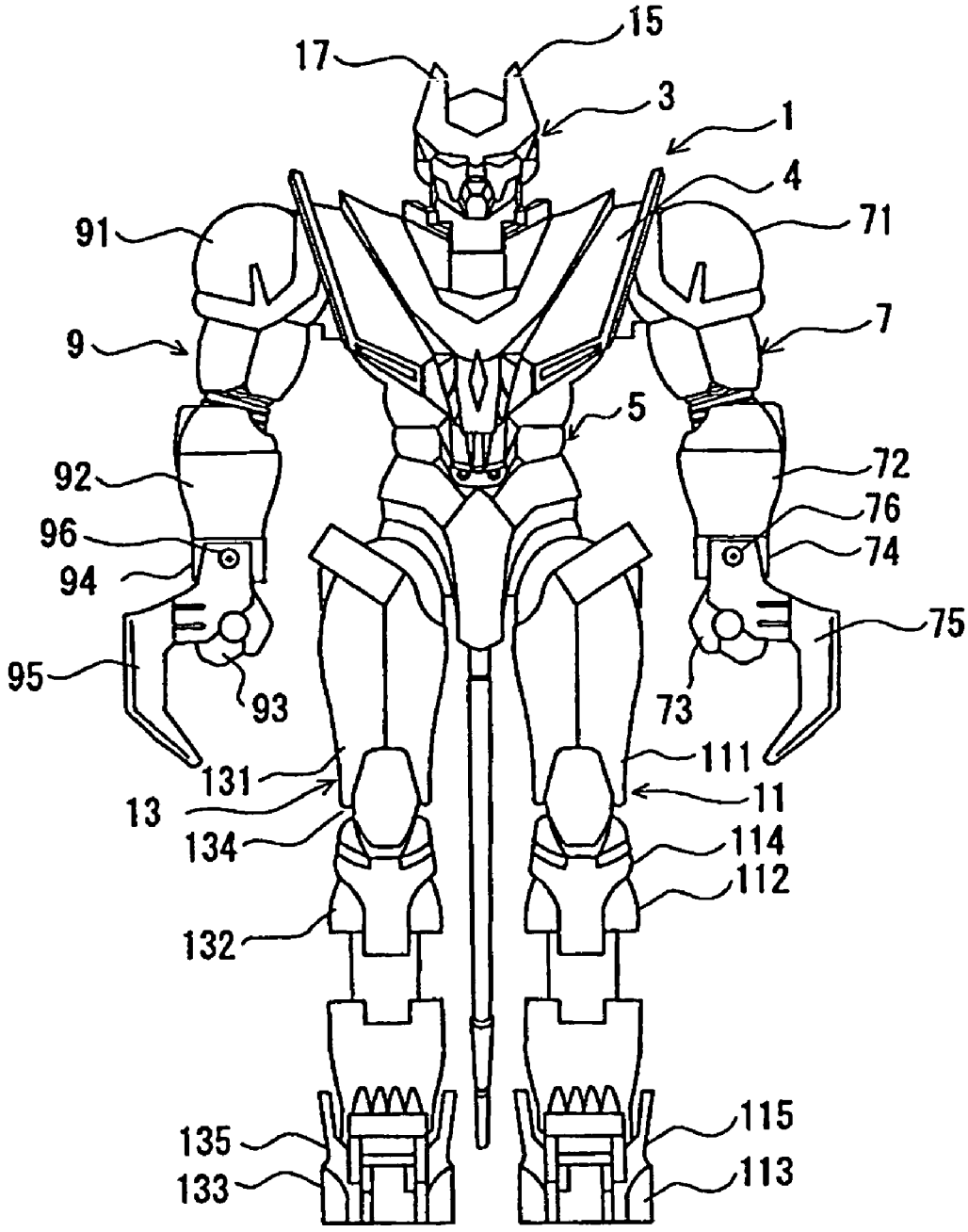
FIG. 1 is a front elevation view when a transformable toy according to an embodiment of the present invention in a figure of a doll robot toy.
Figure 2:
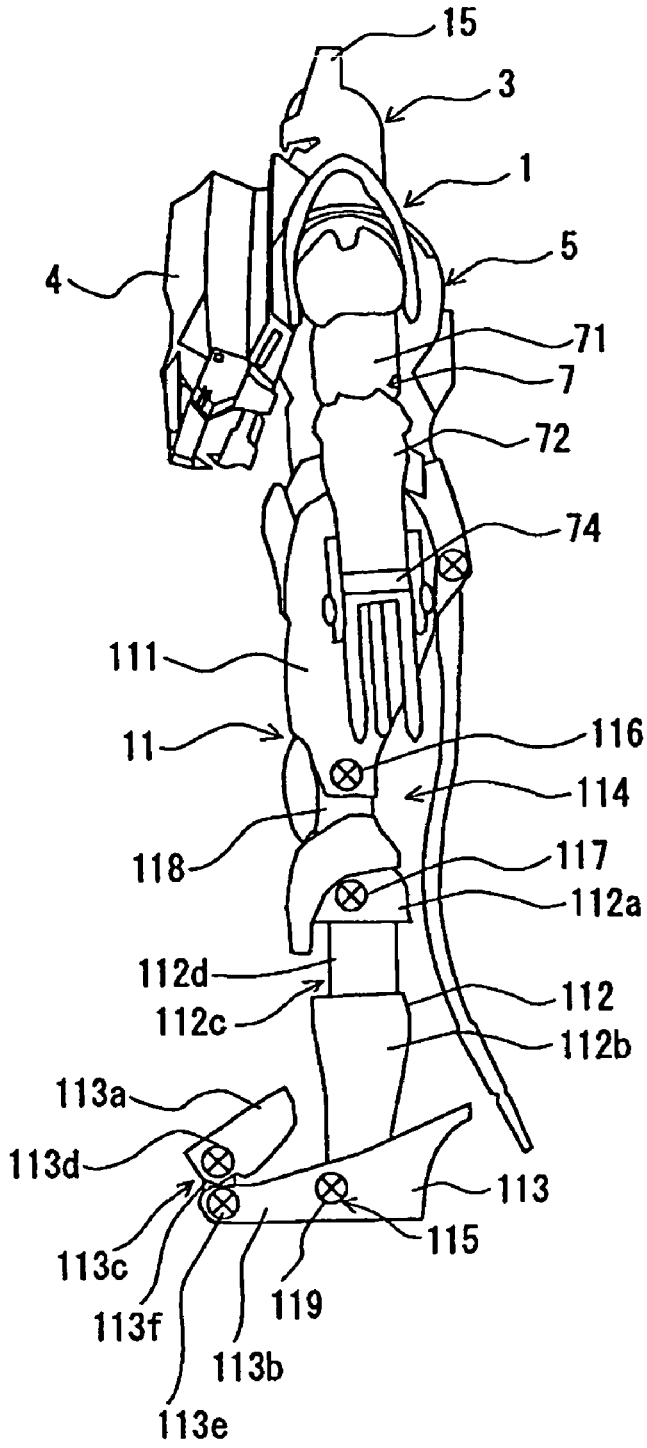
FIG. 2 is a right side elevation view when the transformable toy of the present embodiment is the doll robot toy.
Figure 3:
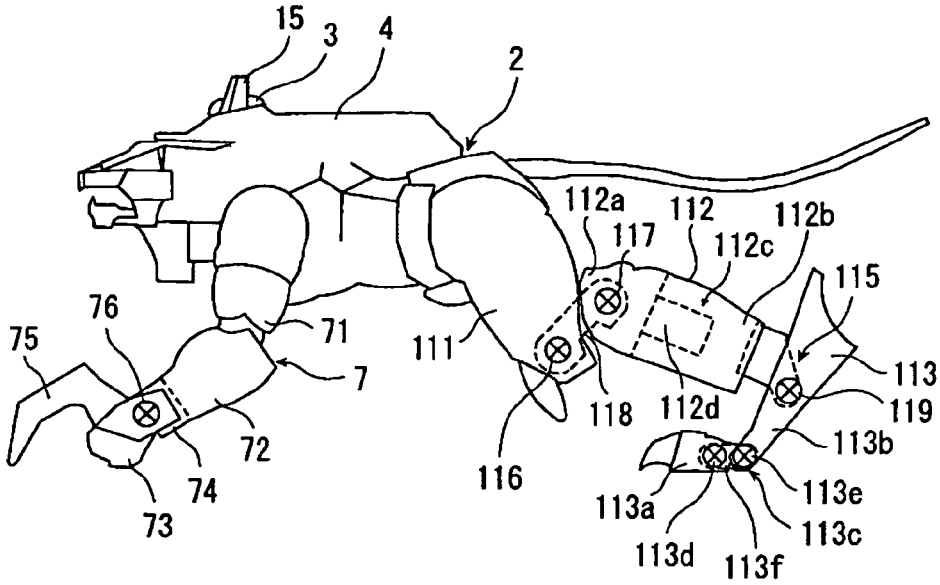
FIG. 3 is a schematic side elevation view when the transformable toy of the present embodiment is a four-legged walking robot toy.
Figure 4:
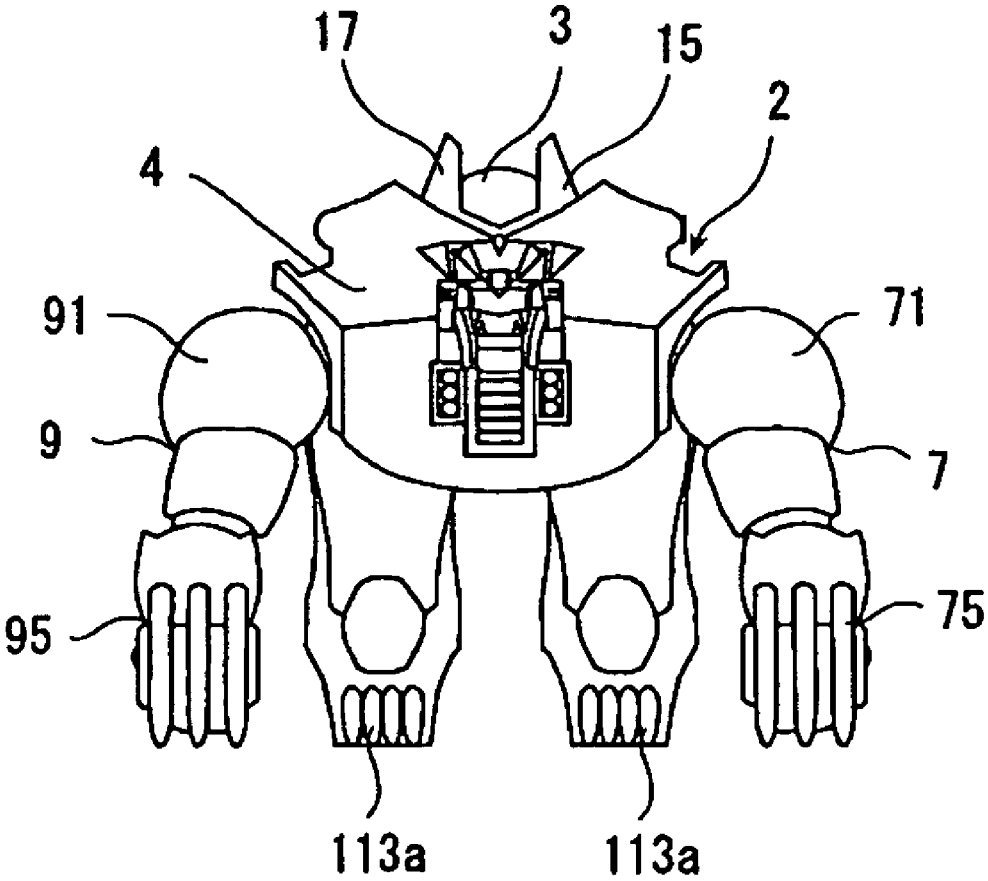
FIG. 4 is a schematic front elevation view when the transformable toy of the present embodiment is the four-legged walking robot toy.

One example embodiment of a transformable toy according to the present invention will be hereinafter drawings. FIGS. 1 and 2 are a front elevation view and a right side elevation view when a transformable toy of the present embodiment is a doll robot toy 1, and FIGS. 3 and 4 are a schematic side elevation view and a front schematic elevation view when the transformable toy of the present embodiment is a four-legged walking robot toy 2. In the transformable toy, a pair of arm sections of the doll robot toy 1 are turned into a pair of foreleg sections of the four-legged walking robot toy 2, and a pair of leg sections of the doll robot toy 1 are turned into a pair of rear-leg sections of the four-legged walking robot toy. The doll robot toy 1 indicated in FIGS. 1 and 2 has a head section 3, a body section 5, a pair of arm sections 7 and 9, and a pair of leg sections 11 and 13. The head section 3 is provided with a pair of projections 15 and 17 like a pair of horns protruding upward. The head section 3 of the doll robot toy 1 is rotatably connected to the body section 5 so that the head section 3 can be rotated at least backward. Specifically, the head section 3 is connected to the body section 5 so that the head section 3 can rotate backward in a predetermined angle range around a rotating shaft (not illustrated) extending in parallel to an imaginary line that connects the both shoulders of the body section 5. As is explained later, owing to the above-described arrangement, when the head section 3 of the doll robot toy 1 is rotated backward and a head base section 4 of the four-legged walking robot toy 2 is placed in the upper position of the body section 5 of the doll robot toy 1 (the state illustrated in FIG. 3) in the process of transforming into the figure of the four-legged walking robot toy 2, the pair of projections 15 and 17 can constitute ear or horn sections of the head section of the four-legged walking robot toy 2.

The head base section 4 of the four-legged walking robot toy 2 is located in the front position of the body section 5 (in front of the chest). The head base section 4 of the four-legged walking robot toy 2 is connected to the body section 5 of the doll robot toy via a pivotally connecting mechanism so that the head base section 4 can move between the front position (in front of the chest) of the body section 5 of the doll robot toy 1 and the upper positions (above both shoulders) of the body section 5 thereof. The pivotally connecting mechanism is a certain connecting mechanism for rotatably supporting a neck portion of the head base section 4 with respect to the body section 5, so that the head base section 4 can move about a hypothetical centerline extending in parallel to the imaginary line which connects the both shoulders of the body section 5. This pivotally connecting mechanism is provided with a locking structure for firmly locking the head base section 4 to the body section 5 so that the head base section 4 may not automatically move to the front position (in front of the chest) when the head base section 4 is placed in the upper position (above both shoulders) of the body section 5. As a result, the above-described mechanism can prevent the head base section 4 from falling down when the transformable toy is in the figure of the four-legged walking robot toy 2 as indicated in FIGS. 3 and 4. Incidentally, the locking structure is constructed in such a manner that locking can be released by applying a little force to the head base section 4 toward the above-mentioned front position.

The pair of arm sections 7 and 9 are respectively attached to the both shoulders of the body section 5 via joint structures which are not illustrated. The pair of arm sections 7 and 9 are provided with upper arm sections 71 and 91, lower arm sections 72 and 92 and hand sections 73 and 93, respectively. The joint structures that are not illustrated have a publicly known configuration that enables the upper arm sections 71 and 91 to move back and forth as well as right and left. Other non-illustrated joint structures which are respectively disposed between the upper arm sections 71 and 91 and the lower arm sections 72 and 92 have a publicly known configuration which enables the lower arm sections 72 and 92 to move back and forth with respect to the upper arm sections 71 and 91, or enables the lower arm sections 72 and 92 to rotate backward and forward about bottom edges of the upper arm sections 71 and 91 in a predetermined angle range. The above joint structures have further a publicly known configuration that enables the lower arm sections 72 and 92 to rotate around the centerlines passing through the core of the upper arm sections 71 and 91 in a predetermined angle range, with respect to the upper arm sections 71 and 91.

Still other joint structures or connections, not illustrated, which connect the lower arm sections 72 and 92 to hand sections 73 and 93 respectively, are provided with a rotatable joint structure having rotating members 74 and 94 that rotate with respect to the lower arm sections 72 and 92 as well as the hand sections 73 and 93, around the centerline extending in a direction from the lower arm sections 72 and 92 to the hand sections 73 and 93. The rotating members 74 and 94 have big claw members 75 and 95 attached thereto respectively. The claw members 75 and 95 are rotated in a predetermined angular range around axes 76 and 96 that intersect perpendicularly with the rotation center of the rotating members 74 and 95 respectively. Such an arrangement enables the claw members 75 and 95 to be arranged to the sides of hand sections 73 and 93 in a figure of the doll robot toy 1 as shown in FIGS. 1 and 2. As well, in a figure of the four-legged walking robot toy 2 as shown in FIGS. 3 and 4, the claw members 75 and 95 can be arranged ahead of the hand sections (on the backs of the hand sections), enabling the claw members to be arranged in a location suitable for each figure of the toy robot.

The head section 3 of the doll robot toy 1 is so of the four-legged walking robot toy 2 so that the head section 3 of the doll robot toy 1 can constitute a part of the head base section 4 of the four-legged walking robot toy 2 when the head body of the four-legged walking robot toy 2 is placed in the upper position.

The pair of leg sections 11 and 13 comprise thigh sections 111 and 131 attached via joint structures (not illustrated) to the body section 5, shin sections 112 and 132, and foot sections 113 and 133 respectively. Each of the leg sections 11 and 13 has a knee-position connecting mechanism 114 for connecting the thigh section and the shin section, and an ankle-position connecting mechanism 115 for connecting the shin section 112 and the foot section 113. Since the constructions of the pair of the leg sections 11 and 13 are the same, hereinafter is explained the construction of only the leg section 11 referring to FIGS. 2 and 3. The knee-position connecting mechanism 114 includes a connecting link 118 connected to the thigh section 111 and the shin section 112 with turning pairs 116 and 117 respectively. The turning pairs 116 and 117 rotatably connect the ends of the connecting link 118 to the thigh section 111 and the shin section 112 respectively. The ankle-position connecting mechanism 115 is constructed in such a manner that the shin section 112 and the foot section 113 are connected with a turning pair 119. Therefore, the foot section 113 rotates around the turning pair 119 in a predetermined angular range.

The shin section 112 is length-adjustably constructed so as to become the longest in a figure of the doll robot toy 1 and become the shortest in a figure of the four-legged walking robot toy 2. More specifically, the length of the shin section 112 can be adjusted as follows. The shin section is constituted from a first section 112*a* connected to the connecting link 118, a second section 112*b* connected to the foot section 113, and a slidably connecting mechanism 112*c* for slidably connecting the first section 112*a* and the second section 112*b* so that the first and second sections may slide close and apart from each other. The slidably connecting mechanism 112*c* has piston section 112*d* fixed to the side of the first section 112*a* and a cylinder section having a stopper structure for preventing the piston section 112*d* from sipping off and provided on the side of the second section 112*b*. With such an arrangement, the length of the shin section 112 can be adjusted by an easy operation of holding either of the first section 112*a* or the second section 112*b* fixedly while moving or sliding the other. In a figure of the doll robot toy 1, the necessary/sufficient length for the leg sections 11 and 13 can be acquired. In a figure of the four-legged walking robot toy 2, on the other hand, the rear-leg sections of the four-legged walking robot toy 2 can be transformed into a more natural shape, which is achieved by shortening the length of the shin sections 112 and 132 and then by appropriately rotating the connecting link 118 connected to the thigh section 111 and the shin section 112 with the turning pairs 116 and 117 respectively.

Further, as illustrated in FIGS. 2 and 3, the foot section 113 includes a foot-claw section 113*a* and a foot base section 113*b* and a movably connecting mechanism 113*c* connecting the foot-claw section 113*a* to the foot base section 113*b* so that the foot-claw section 113*a* may move with respect to the foot base section 113*b*. The movably connecting mechanism 113*c* includes a connecting link 113*f* that is connected to the foot-claw section 113*a* and to the foot base section 113*b* with turning pairs 113*d* and 113*e* respectively. In this manner, the foot-claw section 113*a* can be arranged entirely on the instep of the foot base section 113*b* by appropriately setting the length of the connecting link 113*f*. As a result, the figure of the foot section 113 of the doll robot toy 1 will never become unnaturally long.

Figure 5:
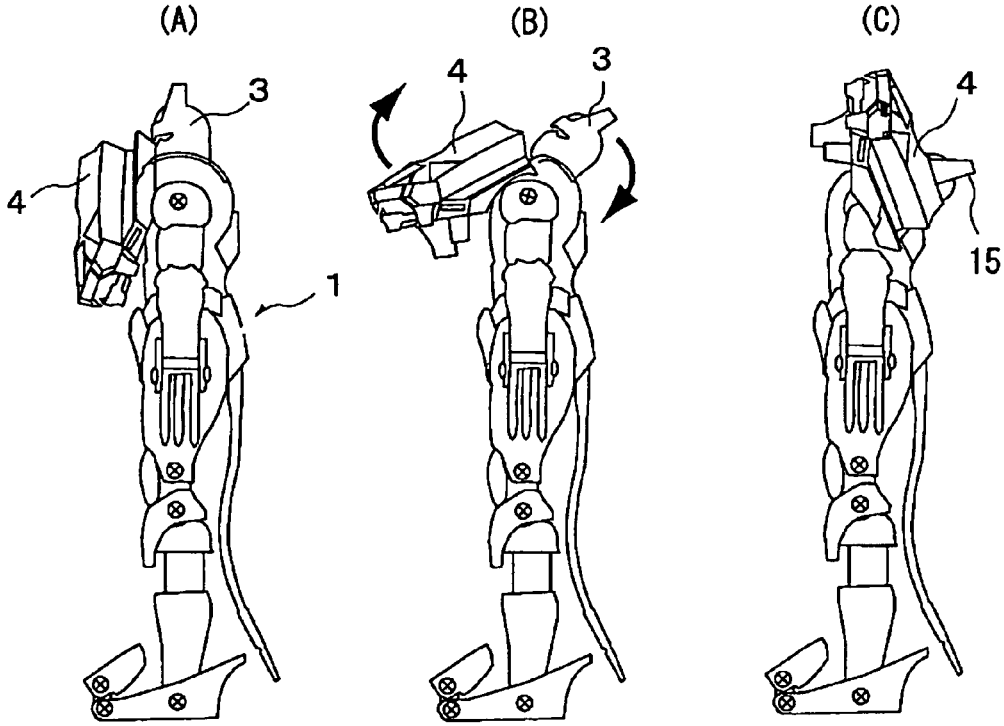
FIGS. 5(A) through 5(C) are views representing the transforming process from a doll robot toy into a four-legged walking robot toy in respect of movements of a head section of the doll robot toy and a head base section of the four-legged walking robot toy respectively.
Figure 6:
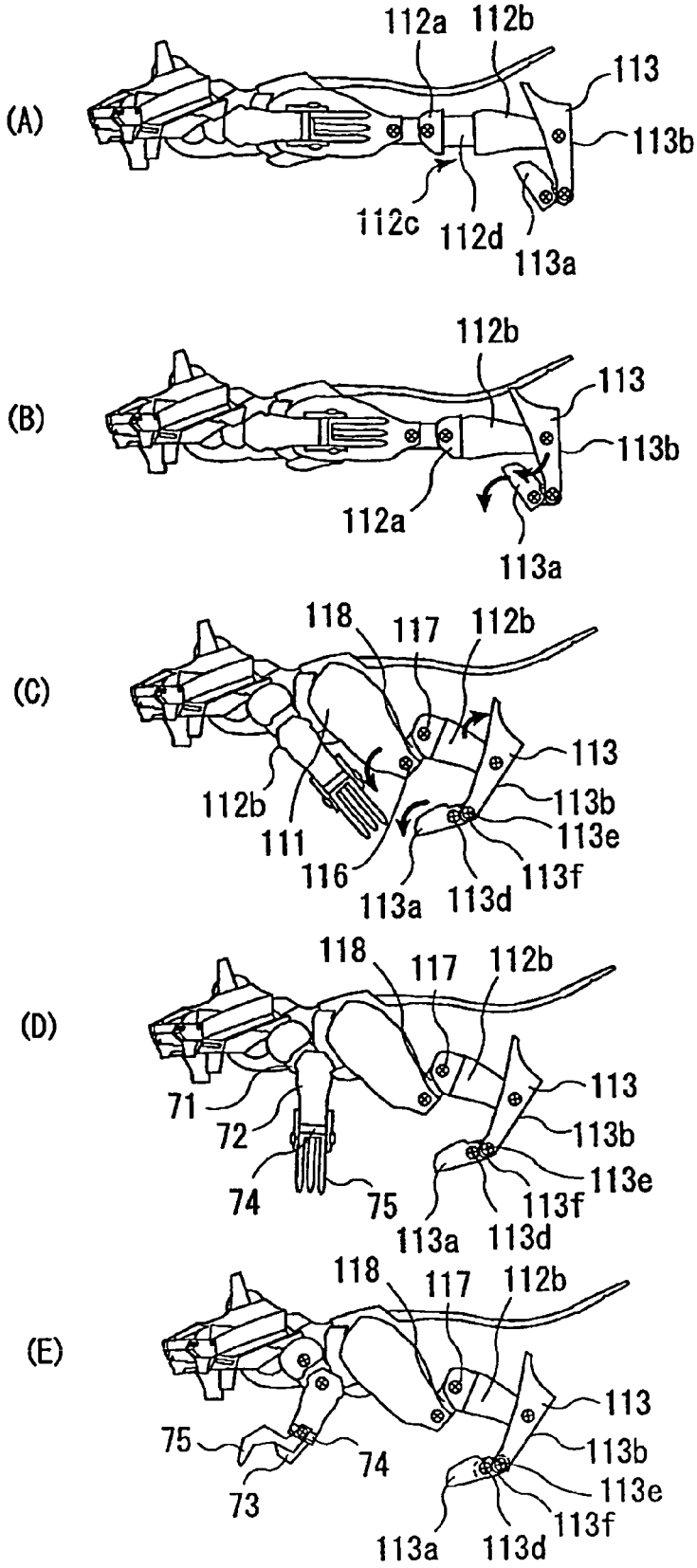
FIGS. 6(A) through 6(E) are views representing the transforming process from a doll robot toy into a four-legged walking robot toy in respect of movements of arm sections and leg sections of the doll robot toy respectively.

FIGS. 5(A) through 5(C) represent the respective transforming processes from the doll robot toy 1 into the four-legged walking robot toy 2 in respect of movements of the head section 3 of the doll robot toy 1 and the head base section 4 of the four-legged walking robot toy 2. FIGS. 6(A) through 6(E) represent the respective transforming processes from the doll robot toy 1 into the four-legged walking robot toy 2 in respect of movements toy 1. In FIGS. 5 and 6, some sections represented in FIGS. 1 and 2 are omitted in order to simplify a graphic display. In the transformation process from FIG. 6(A) into FIG. 6(B), the slidably connecting mechanism 112*c* of the shin section 112 is shortened. And in the transformation process of from FIG. 6(B) into FIG. 6(C), the thigh section 111 and the shin section 112 are rotated in opposite directions to each other about the turning pairs 116 and 117 provided at the ends of the connecting link 118. At the same time, the foot base section 113*b* is rotated about the turning pair 119 while the foot-claw section 113*a* and the connecting link 113*f* are rotated about the turning pairs 113*d* and 113*e*, respectively. As a result of series of the above-described operations, the leg sections of the doll robot toy 1 are transformed into the rear-leg sections of the four-legged walking robot toy 2. Further at this time, the upper arm section 71 is rotated forward. In the transformation process from FIG. 6(C) into FIG. 6(D), the lower arm section 72 provided below the upper arm section 71 is rotated forward about the bottom edge of the upper arm section 71. In the transformation process from FIG. 6(D) into FIG. 6(E), the rotating member 74 rotates 90 degrees to locate the claw member 75 in front of the hand section 73. By series of the above-described operations, the arm sections of the doll robot toy 1 can be transformed into the foreleg sections of the four-legged walking robot toy 2. In order to transform the figure into the doll robot toy 1 from the four-legged robot toy 2, what is necessary is just to reverse the above-described processes.

INDUSTRIAL APPLICABILITY

According to the present invention, a transformable toy can obtain necessarily/sufficiently long legs when it is in a figure of a doll robot figure, and have its rear-legs of a more natural shape. The more natural shape can be achieved by shortening the length of shin sections, and then appropriately rotating a connecting link which connects thigh sections and the shin sections with turning pairs, and rotating foot sections with respect to the shin sections.

The invention claimed is:

1. A transformable toy, a figure of which is transformed between a doll robot toy and a four-legged walking robot toy, said doll robot toy comprising:

a pair of arm sections, and a pair of leg sections, each of the leg sections including:

a thigh section, a shin section, a foot section, a knee-position connecting mechanism for connecting said thigh section to said shin section, said knee-position connecting mechanism including a connecting link connected to said thigh section and said shin section respectively with turning pairs, and an ankle-position connecting mechanism for connecting said shin section to said foot section, said ankle-position connecting mechanism being so constructed as to connect said shin section and said foot section with a turning pair, and said four-legged walking robot toy comprising:

a pair of foreleg sections and a pair of rear-leg sections, wherein said pair of arm sections of said doll robot toy are turned into said pair of foreleg sections of said four-legged walking robot toy, and said pair of leg sections of said doll robot toy are turned into said pair of rear-leg sections of said four-legged walking robot toy; and said shin section is constructed so that a length thereof can be adjusted.

2. The transformable toy as defined in claim 1, wherein said shin section comprises a first section connected to said connecting link, a second section connected to said foot section, and a slidably connecting mechanism for slidably connecting said first section and said second section so that the first and second sections may slide close to and apart from each other.

3. The transformable toy as defined in claim 1, wherein said foot section comprises a foot-claw section, a foot base section, and a movably connecting mechanism for movably connecting said foot-claw section to said foot base section so that said foot-claw section can move with respect to said foot base section.

4. The transformable toy as defined in claim 3, wherein said movably connecting mechanism includes a connecting link connected to said foot-claw section and said foot base section respectively with turning pairs.

5. The transformable toy as defined in claim 1, wherein a head base section of said four-legged walking robot toy is movably connected to said body section of said doll robot toy via a pivotally connecting mechanism so that said head base section can move between a front position and an upper position of said body section of said doll robot toy; and a head section of said doll robot toy is so constructed as to be received in said head base section of said four-legged walking robot toy so that said head section of said doll robot toy may constitute a part of said head base section of said four-legged walking robot toy when said head base section of said four-legged walking robot toy is placed in said upper position.

6. The transformable toy as defined in claim 4, wherein said head section of said doll robot toy is provided with a pair of projections protruding upward, and is rotatably connected to said body section so that said head section can be rotated at least backward; and in a figure of said four-legged walking toy, said head section of said doll robot toy is adopted to be rotated backward so that said pair of projections may constitute ear sections or horn sections of said four-legged walking robot toy.

7. The transformable toy as defined in claim 1, wherein each of the arm sections of said doll robot toy includes an upper arm section, a lower arm section, a hand section, and a connecting section for connecting said lower arm section to said hand section, said connecting section having a rotatable joint structure provided with a rotating member that rotates, with respect to said lower arm section and said hand section, around a centerline extending in a direction from said lower arm section to said hand section, and said rotating member having a claw member mounted thereon, which serves as a weapon in a figure of said doll robot toy, and serves as a claw provided at said foreleg section in a figure of said four-legged walking robot toy.

* * * * *